US005364348A

United States Patent [19]

Berry, Sr.

[11] Patent Number: 5,364,348

[45] Date of Patent: Nov. 15, 1994

[54] DEVICE FOR SUPPLYING FOOD TO A PERSON WHILE AVOIDING CHOKING

[76] Inventor: Donald P. Berry, Sr., 391 Magnolia Pl., DeBary, Fla. 32713

[21] Appl. No.: 130,763

[22] Filed: Oct. 4, 1993

[51] Int. Cl.[5] ..... A47G 19/22

[52] U.S. Cl. ..... 604/77

[58] Field of Search ..... 606/234–236; 604/890.1, 19, 54, 57, 82, 92, 264, 77–79

[56] References Cited

U.S. PATENT DOCUMENTS

| | | | |
|---|---|---|---|
| 1,095,264 | 5/1914 | Bridges | 606/235 |
| 2,665,693 | 1/1954 | Pecora | 606/235 |
| 3,022,915 | 2/1962 | Mullin | 606/234 |
| 3,076,574 | 2/1963 | Woodbury, Jr. . | |
| 3,610,248 | 10/1971 | Davidson . | |
| 3,742,950 | 7/1973 | Endrody . | |
| 4,192,307 | 3/1980 | Baer . | |
| 4,488,551 | 12/1984 | Connelly | 606/236 |
| 4,915,242 | 4/1990 | Marte . | |
| 5,078,734 | 1/1992 | Noble | 606/235 |
| 5,085,634 | 2/1992 | Lackney . | |
| 5,123,915 | 6/1992 | Miller et al. | 606/234 |
| 5,176,705 | 1/1993 | Noble . | |

FOREIGN PATENT DOCUMENTS

| | | | |
|---|---|---|---|
| 0146760 | 7/1920 | United Kingdom | 606/234 |
| 0788905 | 1/1958 | United Kingdom | 606/234 |

*Primary Examiner*—C. Fred Rosenbaum

*Assistant Examiner*—Manuel Mendez

*Attorney, Agent, or Firm*—Julian C. Renfro

[57] ABSTRACT

A device for feeding a young child or impaired adult without the threat of the person choking, my device comprising a handle member in combination with a food dispensing member. The handle member has a generally circularly configured end thereon, upon which circular end, a ring mounting arrangement is provided. A ring having a circularly-shaped aperture therein is utilized with the handle member, with an inner surface of the ring being equipped with a component for tightly engaging the ring mounting arrangement. The component inside the ring for engaging the ring mounting arrangement is configured to operably engage the circular end of the handle member. The food dispensing member is an elongate container of fine mesh material having an aperture therein through which solid or semi-solid food can be inserted, with such food intended to at least partially dissolve in the mouth of the person being fed. The aperture in the container is of a size that can be readily accommodated in the circularly-shaped aperture of the ring as well as being able to fit over the ring mounting means of the handle member, whereby upon food being placed in the container and the open end of the container placed over the ring mounting arrangement, the ring can be tightened upon the handle member so as to form a unitary device that can be held by the person, and the container placed in the mouth of the person.

17 Claims, 1 Drawing Sheet

DEVICE FOR SUPPLYING FOOD TO A PERSON WHILE AVOIDING CHOKING

RELATIONSHIP TO PREVIOUS DOCUMENTATION

This invention bears a close relationship to the document entitled "Baby Safe Feeder" filed in the U.S. Patent and Trademark Office on Jun. 25, 1993 in connection with the Disclosure Document Program. This became Disclosure Document No. 334,203.

BACKGROUND OF THE INVENTION

Almost everyone is well aware of the fact that liquid food can be supplied to a child from a bottle provided with a nipple, with such nipple often being held in place by virtue of mounting the nipple in a ring that is equipped with internal screw threads. Used with this nipple and ring is a bottle having external threads extending around the open end, so that by tightly screwing the ring onto the top of the bottle, a liquid tight arrangement is brought about. After the milk, orange juice or other liquid food has been fully administered, the ring is unscrewed from the top of the bottle so that a thorough washing of all of these components can be readily brought about.

Typically the mother or other care giver introduces the infant to spoon feeding in the age range of six to eight months, but sometimes the transition from nipple to spoon can be difficult for the infant.

One of the objects of this invention, therefore, is to provide a means whereby a transitional phase is set up during the baby's development between the milk-nipple stage and the food-spoon stage. The administering of certain foods, such as semi-solid foods, in the early period of development becomes easier because of the baby's familiarity with a nipple, and this makes subsequent spoon training faster and easier, because when a spoon is first presented with food in it, the baby will already be familiar with the food. Consequently, crossing the "spoon barrier" becomes a simple matter.

Another important consideration is the fact that when an infant is starting to take semi-solid and solid food, the possibility of choking can be a constant threat. Therefore, when a child is being given a piece of a hot dog, for example, the mother or other care giver should cut the hot dog longitudinally before cutting it into pieces. This is advisable because a generally cylindrically shaped piece of hot dog is of a configuration that could easily form a blockage in the throat of a child or impaired adult, and cause him or her to choke to death if help is not quickly forthcoming.

I am aware that there are many items on the market, such as baby crackers, baby cookies, baby toast and the like that are intended as snacks for an infant to chew on while teething or while the infant has only a few teeth. Even though such items are ostensibly for infants, it is nevertheless quite possible for an infant or impaired adult to break off a piece of such an item and choke on it.

It was in an effort to supplement and improve upon previously known feeding practices that the present invention was evolved.

SUMMARY OF THE INVENTION

In accordance with this invention, I provide a device for feeding food, typically semi-solid food, to a young child or to a person unable to manage the use of a fork or spoon, without the threat of the person choking. In other words, my invention is usable in the nursery, or in a location involving the administration of food by a care giver to a child, or to an adult with a physical or mental impairment.

My novel device comprises a handle member in combination with a food dispensing member, with the handle member having a generally circularly configured end thereon. Around this circular end of the handle member, ring mounting means are disposed, so that a ring capable of securing the food dispensing member in a desired operative position can be tightly fastened upon the handle member. I prefer to utilize external screw threads on the handle member, and to provide internal threads around the interior of the ring.

The internally threaded ring utilized in combination with the handle member has a generally circularly-shaped aperture therein. When the internal threads of the ring have threadedly engaged the external threads disposed around the circular end of the handle member, a flange disposed around the interior of the ring is brought into firm contact with a circular part of the handle, thereby to hold the food dispensing member tightly against the handle member.

The food dispensing member I prefer to utilize is typically in the form of an elongate container of fine mesh material, with one end of the container open, and the other end closed. This elongate container is adapted to receive therein, food of such a nature as to be dissolved in the mouth, thus enabling liquified food to pass through the fine mesh material of the container, and be ingested by the person. The open end of the container is of a size that can be readily accommodated in the generally Circularly-shaped aperture of the ring as well as being able to fit over the threaded end of the handle member. Therefore, upon food being placed in the container and the open end of the container placed over the threaded end of the handle member, the ring can be tightened upon the threads disposed around the end of the handle member So as to form a unitary device that can be held by the child or impaired adult in such a manner that the closed end of the container can be placed in the person's mouth.

Examples of solid or semi-solid food that can be readily dissolved in the mouth of the person are pieces of bread, small pieces of cooked potato, pretzel pieces, jello, certain cereals, cookie crumbs and rock candy. Further examples are carrots, apples, cooked or raw food and the like.

I typically construct the handle member of plastic, preferably a strong, industrial grade plastic, although I am not to be limited to this. Usually I create the mesh container out of suitable cloth, and I may utilize a draw string around the open end of the container as a safety feature. Upon the open end of the container being placed around the threaded end of the handle member, the draw string can be pulled tight and then tied to the handle, making it unlikely that the elongate container could become separated from the handle member, even if the ring should somehow became unscrewed.

As an additional step taken to make sure that the elongate container or food dispensing member is tightly gripped, I may utilize a ring around whose interior, a flange is located, which can be brought into tight contact with a circular, dome-shaped portion of the handle member, thus to tightly grip the food dispensing member.

It is thus to be seen that a primary object of this invention is to provide a feeding device for safely feeding an infant, small child or impaired adult without the danger of such person choking on the food.

It is another object of this invention to provide a feeding device of simple and straight-forward configuration, that can be manufactured and marketed at a relatively low cost, yet forming an entirely safe feeding arrangement for a child or impaired adult.

It is yet another object of this invention to provide a food dispensing member of fine mesh construction such that relatively soft, solid or semi-solid food items placed in the dispensing member can be dissolved by the person's saliva and thereafter ingested, this being accomplished without any possibility of the person choking upon such food.

It is yet still another object of this invention to provide a means for tightly securing a food dispensing member of fine mesh construction upon a handle member, such that a child or impaired adult can readily learn to put the food dispensing member in his or her mouth and ingest the food value from the solid or semi-solid food placed in the dispensing member, without risking the danger of the person choking.

It is yet another object of this invention to provide a multi-component feeding device that can be easily assembled when ready to be put into use, but which can be readily disassembled for sterilization subsequent to use.

It is yet still another object of this invention to provide a multi-component feeding device utilizing a food dispensing member of safe yet inexpensive construction, such that this member can be discarded immediately after use.

These and other objects, features and advantages will become more apparent from a study of the appended Figures of drawing.

DETAILED DESCRIPTION

Figure 1:
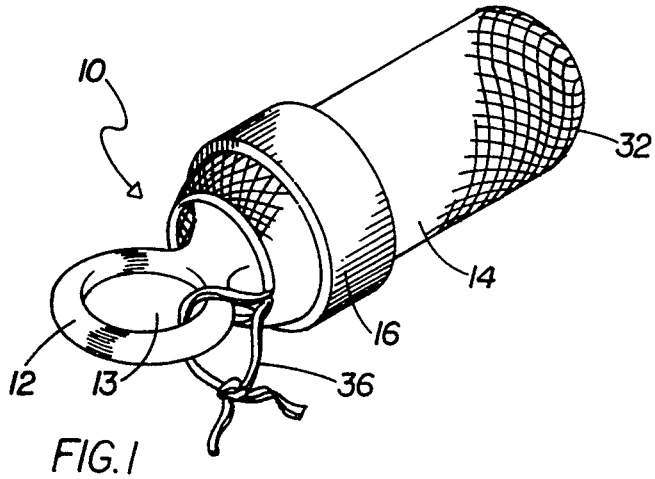
FIG. 1 is an assembled view of my novel safe feeder, by the use of which readily dissolved food can be safely administered to an infant, small child or impaired adult.

With initial reference to FIG. 1, it will be seen that I have illustrated my safe feeding device 10 in its fully operative position, such that readily dissolved food may be administered to a child or impaired adult without the threat of choking. The device 10 comprises a handle member 12 in combination with a food dispensing member 14. The food dispensing member 14 is firmly fastened to the handle member 12 by the use of an encircling ring 16 whose construction will be described at further length hereinafter.

Figure 2:
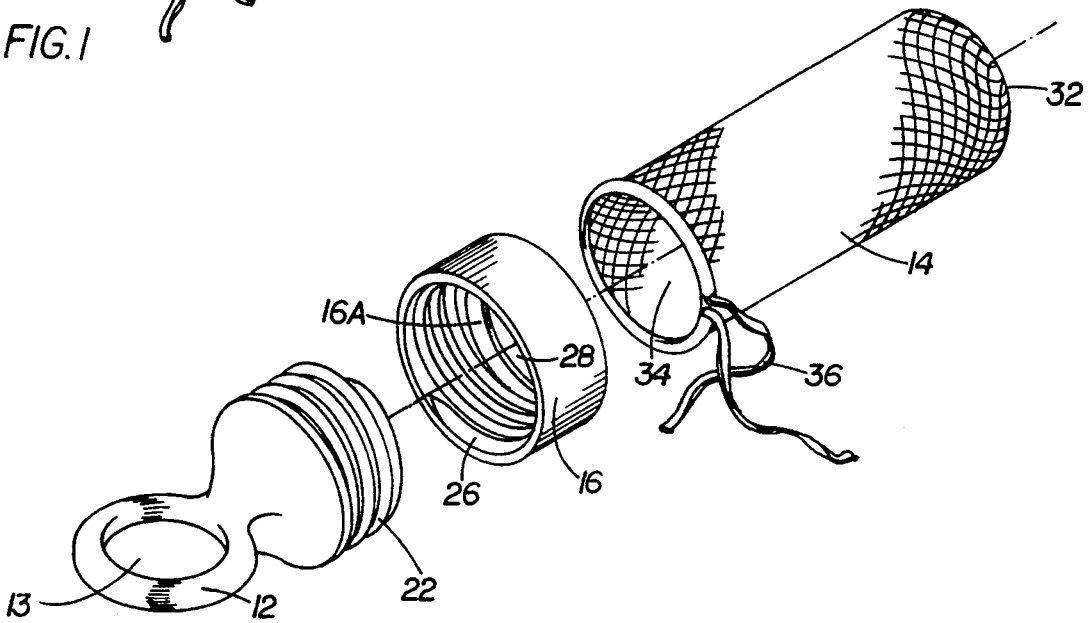
FIG. 2 is an exploded view of my baby safe feeder, revealing the separate components that constitute this invention, which are the handle member, the threaded ring able to engage thee male threads disposed around one end of the handle member, and the food dispensing member, these components being utilized in combination in order to form a safe feeding device.

Visible in FIG. 1 as well as in FIG. 2 is the handle member 12, which is typically of plastic, preferably of a strong, industrial grade plastic that can resist being brought to sterilization temperatures for a large number of times without significantly deteriorating. The handle 12 may be provided with an aperture 13.

In FIG. 2 it is important to note that the handle member 12 has a generally circularly configured end 20 thereon, around which circular end, ring mounting means are disposed. As will be noted, I prefer for the ring mounting means to take the form of external screw threads 22 on the circular end of the handle member.

Figure 2A:
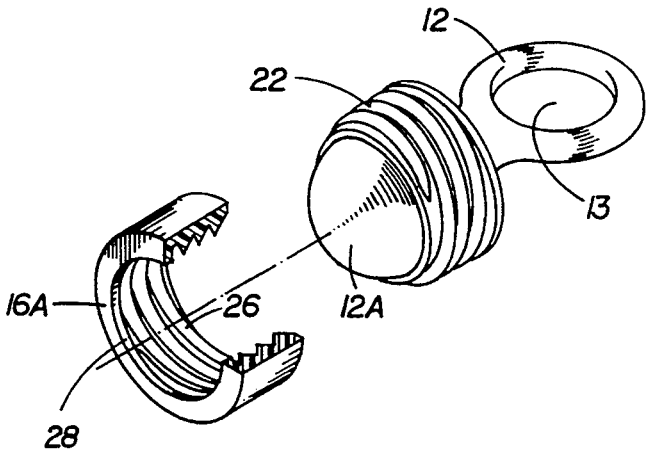
FIG. 2A is an exploded view of two of the components that constitute my feeder device, this view revealing that the handle member has a domed end, and that the threaded ring has an internal flange.

Also visible in FIG. 2 as well as in FIG. 2A is the ring 16, the interior of which is equipped with internal means such that it can be tightly interfitted upon the ring mounting means of the handle member 12. I prefer for the internal means of the ring to take the form of internal threads 26 that are created so as to threadedly engage the threads 22 at the end 20 of the handle member 12. The ring 16 has a generally circularly-shaped aperture 28 therein, the diameter of which is determined by the flange 16A that extends around one end of the ring.

Additionally depicted in FIG. 2 is the food dispensing member 14, which can be seen to be an elongate container of fine mesh material having a closed end 32, but having an open end 34. The member 14 may be of cloth, such as nylon or polyester, although certain closely woven plastic meshes may also be utilized in certain circumstances.

The open end 34 is of a diameter such that it can fit through the aperture 28 of the ring 16 and still be received upon the threads 22 or other ring mounting means utilized on the end of the handle member 12. Additionally, I may utilize a securing means such as a draw string 36 operatively disposed around the open end 34, so that after the open end has been placed around the threaded end 20 of the handle 12, the draw string 36 can be pulled tight and thereafter tied to the handle. This will assure that the elongate container of fine mesh material will not be separated from the handle in the unlikely event that the ring 16 becomes loosened.

I am not limited to any particular size of the elongate food dispensing member, but the length of the member is typically two or three times as great as its diameter.

As will be obvious, the length of the effective portion of the elongate food dispensing member can be readily adjusted by the care giver making a decision of how much of the food dispensing member 14 is pulled over the circular end of the handle member 12 before the ring 16 is tightly secured thereto.

As can be easily seen, readily dissolved food items may be inserted into the container 14 through the open end thereof, with such food items being in the nature of pieces of bread, pieces of cookie, potato, pieces of pretzel, jello and other solid or semi-solid foods. Upon the person placing the food dispensing member in his or her mouth, the person can commence receiving nutrition shortly after the food items become saturated with his or her saliva. The mesh is of fine enough weave as to assure no large particles coming through that would pose a choking-type jeopardy to the person.

After the person removes the feeding device or falls asleep, the mother or other care giver can remove the feeding device and then proceed to unfasten the ring 16 so that any remaining pieces of food in the food dispensing member can be removed either by shaking, or by turning the food dispensing member inside out. Thereafter all of the components 12, 14 and 16 can be sterilized for subsequent use.

Some food dispensing members may be of relatively permanent construction, such as of nylon or polyester, and in that instance the food dispensing member can be reused after sterilization. On the other hand, other food dispensing members of inexpensive construction, such as of cotton mesh, can be discarded immediately after use.

As is obvious, the size of the mesh opening of the food dispensing member utilized in a given instance can be chosen with regard to the physical size and health of the person involved. Typically, a relatively small mesh would be utilized with an infant, whereas a larger mesh could be Utilized by a care giver when feeding an adult with a physical or mental impairment.

Some embodiments of the mesh utilized in accordance with my invention have involved something on the order of twelve openings per lineal inch, whereas other embodiments have had approximately eighteen openings per lineal inch. Stated in terms of openings per square inch, these can range between 144 openings and 324 openings per square inch.

From an inspection of FIG. 2A, it can be seen that I have revealed that the threaded end of the handle member 12 is provided with a domed portion 12A, with the aforementioned threads 22 being disposed in a surrounding relationship to the domed portion 12A. Also to be noted in FIG. 2A is the fact that the aperture 28 in the internally threaded ring 16 is determined by the size of the flange 16A. I deliberately size the flange 16A such that the circumferential portion representing the innermost part of the ring is in tight contact with a circularly-shaped lower part of the domed portion 12A at such time as the ring 16 is tightly secured to the handle member 12.

Figure 2B:
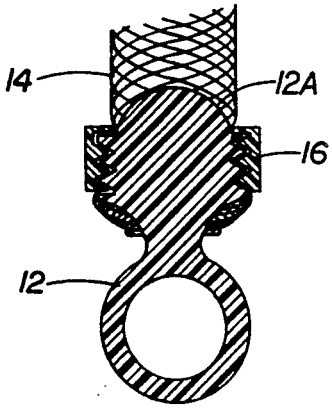
FIG. 2B is a view revealing that the internal flange of the threaded ring makes tight contact with a circular portion of the domed end, thus to tightly grip the elongate food-containing member.

With reference now to FIG. 2B, it will be seen that the circumferential portion representing the innermost part of the flange 16A makes tight contact with the largest diameter portion of the dome-shaped portion 12A when the ring 16 has been tightly secured to the handle member 12. One reason for this construction is that I wish for the food dispensing member 14 to be tightly gripped at such time as the ring 16 has been tightened securely upon the handle member, so that the person being fed cannot easily pull the food dispensing member away from the handle member. Another reason is that the tightly fitting relationship between the flange 16A and the dome-shaped portion helps to seal out the food from getting down between the threads 22 of the handle member, and the internal threads 26 of the ring 16.

Other embodiments within the spirit of my invention will be obvious to those skilled in this art.

I claim:

1. A device for feeding a young child or impaired adult without the threat of the person choking, said device comprising a handle member in combination with a food dispensing member, said handle member having a generally circularly configured end thereon, upon which circular end, ring mounting means are disposed, a ring utilized with said handle member, the inner surface of said ring being equipped with internal means for being tightly interfitted with said ring mounting means, said ring having a circularly-shaped aperture therein, said internal means on said ring being configured to operably engage said ring mounting means disposed around said circular end of said handle member, said food dispensing member being in the form of an elongate container of fine mesh material having approximately a minimum of 144 openings per square inch, said container having an aperture therein through which semi-solid food can be inserted, with such food intended to at least partially dissolve in the mouth of the person, said aperture in said container being of a size that can be readily accommodated in said circularly-shaped aperture of said ring as well as being able to fit over said ring mounting means of said handle member, whereby upon food being placed in said container and the open end of said container placed over said ring mounting means, said ring can be tightened upon said handle member so as to form a unitary device that can be held by the person and said container placed in the mouth of the person.

2. The device for feeding a young child or impaired adult without the threat of the person choking as recited in claim 1 in which said handle member has a dome-shaped portion surrounded by said ring mounting means, and said ring has an inwardly extending flange coming into tight contact with a part of said dome-shaped portion at such time as said food dispensing member has been placed over said dome-shaped portion and said ring tightened, said tight contact assuring that said food dispensing member will be tightly gripped.

3. The device for feeding a young child or impaired adult without the threat of the person choking as defined in claim 1 in which said container is made of a cloth mesh.

4. The device for feeding a young child or impaired adult without the threat of the person choking as defined in claim 1 in which said container is made of a plastic mesh.

5. The device for feeding a young child or impaired adult without the threat of the person choking as defined in claim 1 in which the length of said container is more than twice as great as the diameter of said container.

6. The device for feeding a young child or impaired adult without the threat of the person choking as recited in claim 1 in which a care giver can determine the length of said container by a suitable adjustment of how much of said container is placed over said ring mounting means of said handle member before said ring is tightened.

7. The device for feeding a young child or impaired adult without the threat of the person choking as defined in claim 1 in which said handle member is of unitary construction and made of plastic.

8. A device for feeding a young child or impaired adult without the threat of the person choking, said device comprising a handle member in combination with a food dispensing member, said handle member having a generally circularly configured end thereon, upon which circular end, ring mounting means are disposed, a ring utilized with said handle member, the inner surface of said ring being equipped with internal means for being tightly interfitted with said ring mounting means said ring having a circularly-shaped aperture therein said internal means on said ring being configured to operably engage said ring mounting means disposed around said circular end of said handle member, said food dispensing member being in the form of an elongate container of fine mesh material having an aperture therein through which semi-solid food can be inserted with such food intended to at least partially dissolve in the mouth of the person, said aperture in said container being of a size that can be readily accommodated in said circularly-shaped aperture of said ring as well as being able to fit over said ring mounting means of said handle member, whereby upon food being placed in said container and the open end of said container placed over said ring mounting means, said ring can be tightened upon said handle member so as to form a unitary device that can be held by the person and said container placed in the mouth of the person, a tightening means is provided around said hole of said container, said tightening means being a draw string.

9. A device for feeding a young child or impaired adult without the threat of the person choking, said device comprising a handle member in combination with a food dispensing member, said handle member having a generally circularly configured end thereon, around which circular end, external screw threads are disposed, a ring utilized with said handle member, said ring being equipped with internal threads and having a generally circularly-shaped aperture therein, said internal threads of said ring being configured to threadedly engage the external threads disposed around said circular end of said handle member, said food dispensing member being in the form of an elongate container of fine mesh material closed at one end, but with the other end open, said container being adapted to receive therein, food intended to at least partially dissolve in the mouth of the person, the open end of said container being of a size that can be readily accommodated in said generally circularly-shaped aperture of said ring as well as being able to fit over the threaded end of said handle member, whereby upon solid or semi-solid food being placed in said container and the open end of said container placed over said threaded end of said handle member, said ring can be tightened upon the threads disposed around the end of the handle member so as to form a unitary device that can be held by the person and the closed end of said container placed in the mouth of the person.

10. The device for feeding a young child or impaired adult without the threat of the person choking as recited in claim 9 in which said handle member has a dome-shaped portion surrounded by said external screw threads, and said ring has an inwardly extending flange coming into tight contact with a part of said dome-shaped portion at such time as said food dispensing member has been placed over said dome-shaped portion and said ring tightened, said tight contact assuring that said food dispensing member will be tightly gripped.

11. The device for feeding a young child or impaired adult without the threat of the person choking as recited in claim 9 in which a tightening means is provided around said open end of said container.

12. The device for feeding a young child or impaired adult without the threat of the person choking as recited in claim 11 in which said tightening means is a draw string.

13. The device for feeding a young child or impaired adult without the threat of the person choking as defined in claim 9 in which said container is made of a cloth mesh.

14. The device for feeding a young child or impaired adult without the threat of the person choking as defined in claim 9 in which said container is made of a plastic mesh.

15. The device for feeding a young child or impaired adult without the threat of the person choking as defined in claim 9 in which the length of said container is more than twice as great as the diameter of said container.

16. The device for feeding a young child or impaired adult without the threat of the person choking as recited in claim 9 in which a care giver can determine the length of said container by a suitable adjustment of how much of said container is placed over said threaded end of said handle member before said ring is tightened.

17. The device for feeding a young child or impaired adult without the threat of the person choking as defined in claim 9 in which said handle member is of unitary construction and made of plastic.

* * * * *